US006550273B2

(12) United States Patent
Fujitaka et al.

(10) Patent No.: US 6,550,273 B2
(45) Date of Patent: Apr. 22, 2003

(54) AIR CONDITIONER USING FLAMMABLE REFRIGERANT

(75) Inventors: Akira Fujitaka, Shiga (JP); Yoshinori Kobayashi, Shiga (JP); Riko Tachigori, Shiga (JP)

(73) Assignee: Matsushita Electric Industrial Co., Ltd., Kadoma (JP)

( * ) Notice: Subject to any disclaimer, the term of this patent is extended or adjusted under 35 U.S.C. 154(b) by 0 days.

(21) Appl. No.: 09/833,588

(22) Filed: Apr. 13, 2001

(65) Prior Publication Data

US 2001/0037649 A1 Nov. 8, 2001

Related U.S. Application Data

(62) Division of application No. 09/355,954, filed as application No. PCT/JP98/05656 on Dec. 15, 1998.

(30) Foreign Application Priority Data

Dec. 16, 1997 (JP) ..... 9-363492

(51) Int. Cl.[7] ..... F25B 1/00; F28F 13/08
(52) U.S. Cl. ..... 62/498; 165/147; 165/150
(58) Field of Search ..... 165/147, 150; 62/498, 467

(56) References Cited

U.S. PATENT DOCUMENTS

| | | | | |
|---|---|---|---|---|
| 34,648 A | * | 3/1862 | Sherman | 165/147 |
| 3,675,710 A | * | 7/1972 | Riston | 165/147 X |
| 4,995,453 A | * | 2/1991 | Bartlett | 165/150 |
| 6,082,132 A | | 7/2000 | Numoto et al. | 62/498 |

FOREIGN PATENT DOCUMENTS

| | | |
|---|---|---|
| JP | 8-338670 | 6/1988 |
| JP | 63-131965 | 6/1988 |
| JP | 7-113555 | 5/1995 |
| JP | 8-166171 | 6/1996 |
| JP | 9-152216 | 6/1997 |
| JP | 9-280681 | 10/1997 |
| JP | 9-318142 | 12/1997 |
| JP | 9-318208 | 12/1997 |

OTHER PUBLICATIONS

Althouse et al., Modern Refrigeration and Air Conditioning, The Goodheart–Wilcox Company, p. 598, 1979.

"Joukyuu hyoujun text reitou kuuchou gijutsu", edited by The Japanese Association of Refrigeration, Jan. 20, 1998, p. 133, right column, line 8 to p. 143, right column, line 26.

Microfilm of the specification and drawings annexed to the request of Japanese Utility Model Appln. No. 61–43914 (Laid–open No. 62–156714) (Toshiba Corp.), Oct. 5, 1987.

Microfilm of the specification and drawings annexed to the request of Japanese Utility Model Appln. No. 1–7606 (laid–open No. 3–18470) (toshiba Corp.), Feb. 22, 1991.

CD–ROM of the specification and drawings annexed to the request of Japanese Utility Model Application No. 5–62367 (Laid–open No. 7–32460), (Fujitsu General Ltd.), Jun. 16, 1995.

CD–ROM of the specification and drawings annexed to the request of Japanese Utility Model Application No. 4–27611 (Laid–open No. 5–90267), (Calsonic Corp.), Dec. 10, 1993.

* cited by examiner

*Primary Examiner*—William Wayner
(74) *Attorney, Agent, or Firm*—Armstrong, Westerman, & Hattori, LLP

(57) ABSTRACT

In an air conditioner using a flammable refrigerant of the present invention, an inner diameter of a liquid-side connecting pipe is reduced to less than 42.5% of that of a gas-side connecting pipe. By reducing the inner diameter of the pipe in which a liquid refrigerant of the air conditioner is reduced, it is possible to reduce the amount of refrigerant to be charged into the system without decreasing the capacity and the efficiency.

14 Claims, 4 Drawing Sheets

AIR CONDITIONER USING FLAMMABLE REFRIGERANT

This application is a division of prior application Ser. No. 09/355,954, filed Aug. 12, 1999, which is a 371 of PCT/JP98/05656, filed Dec. 15, 1998.

TECHNICAL FIELD

The present invention relates to an air conditioner using a flammable fluid as a refrigerant, and more particularly, to an air conditioner using a flammable refrigerant, especially, HC based refrigerant such as propane, isobutane and the like as a refrigerant.

BACKGROUND TECHNIQUE

HCFC based refrigerants such as R22, which are stable components and composed of hydrogen, chlorine, fluorine and carbon are currently utilized in an air conditioner.

However, HCFC refrigerants rise into the stratosphere and decompose ozone, leading to the destruction of the ozone layer.

In recent years, HFC refrigerants begin to be utilized as alternative refrigerants of HCFCs, but these HFC refrigerants have the nature for facilitating the global warming.

Therefore, a study is started to employ HC refrigerant which does not destroy the ozone layer or largely affect the global warming.

However, since this HC refrigerant is flammable, it is necessary to prevent explosion or ignition so as to ensure the safety.

As a method for preventing the explosion or ignition when HC refrigerant is used, it is proposed to isolate, move away or not to use an ignition source (Japanese Patent Applications Laid-open No.H7-55267 and No.H8-61702, for example).

On the other hand, as another method for preventing the explosion or ignition when HC based refrigerant is used, it is proposed to make the refrigerant itself into a non-flammable refrigerant (Japanese Patent Application Laid-open No.H9-59609), and it is proposed to reduce the amount of refrigerant (Japanese Patent Applications Laid-open No.H8-170859 and No.H8-170860) in the mixture.

Here, the conventional techniques (Japanese Patent Applications Laid-open No.H8-170859 and No.H8-170860) for reducing the amount refrigerant to be used will be explained in more detail.

Japanese Patent Application Laid-open No. H8-170859 and No. H8-170860 relate to a refrigerator. In order to reduce the amount of refrigerant, it is proposed: to provide a heat pipe in addition to a refrigeration cycle and to use non-flammable refrigerant for the heat pipe; to provide a refrigerant tube for heat exchangers in the compartment of the refrigerator separately from a refrigerant tube for an evaporator and to use non-flammable refrigerant for the heat pipe; to change the number of paths upstream and downstream of the evaporator or a condenser; and the like.

First, the method for preventing the explosion or ignition by isolating, moving away or not using the ignition source is very effective if the air conditioner is used alone. However, an air conditioner is used in a closed space, and other equipments may have the ignition source. Therefore, even if safety as an air conditioner may be enhanced, it can not be said that the safety is always ensured depending upon a using state.

The method for preventing the explosion or ignition by making the refrigerant itself into a non-flammable refrigerant does not have the above problem, and it can be said that safety is ensured in any of using states.

However, it is not easy to make the flammable refrigerant itself into a non-flammable refrigerant while achieving a required level of refrigerating performance without adversely affecting the global environment such as decreasing of ozone layer and global warming.

The method for reducing the refrigerant amount may not always prevent the explosion or ignition perfectly, but it contributes to effective utilization of resources. Further, even if a harmful influence may be found in the future, if the amount of refrigerant is small, such a harmful influence can be suppressed to the minimum.

Thereupon, it is an object of the present invention to technically reduce a risk of explosion or ignition and to enhance the safety by reducing an amount of refrigerant to be charged in the refrigeration cycle.

Meanwhile, if the amount of refrigerant to be charged in the refrigeration cycle is reduced without changing other conditions, since the circulation amount of refrigerant is reduced, there is a problem that cooling capacity is decreased. Further, if the compression volume is increased or the revolution number of the compressor is increased so as to prevent the cooling capacity from being decreased, there is a problem that power input is increased and the efficiency is decreased.

Thereupon, a primary object of the invention is to reduce the amount of refrigerant to be charged in the refrigeration cycle without decreasing the capacity and efficiency.

Further, a secondary object is to reduce the amount of refrigerant to be charged in the refrigeration cycle without decreasing the capacity if R290 is used as a refrigerant or mainly used as the refrigerant mixtures, while obtaining substantially the same efficiency as the case in which R22 is used as refrigerant.

DISCLOSURE OF THE INVENTION

An air conditioner using a flammable refrigerant according to a first aspect of the present invention, an inner diameter of a liquid-side connecting pipe is smaller than 42.5% of an inner diameter of a gas-side connecting pipe.

According to a second aspect of the invention, an inner diameter of the liquid-side connecting pipe is 1 mm to 3.36 mm.

According to a third aspect, the liquid-side connecting pipe is a capillary tube.

An air conditioner using a flammable refrigerant according to a fourth aspect, an inner diameter of a liquid-side tube of the outdoor unit is smaller than 42.5% of an inner diameter of a gas-side tube of the outdoor unit.

An air conditioner using a flammable refrigerant according to a fifth aspect an inner diameter of a liquid-side tube of the indoor unit is smaller than 42.5% of an inner diameter of a gas-side tube of the indoor unit.

According to a sixth aspect, an inner diameter of the liquid-side tube of the fourth or fifth aspect is 1 mm to 3.36 mm.

According to a seventh aspect, the liquid-side tube of the fourth or fifth aspect is a capillary tube.

A refrigeration cycle using a flammable refrigerant according to an eighth aspect, an inner diameter of a liquid-side tube of the tube is smaller than 42.5% of an inner diameter of a gas-side tube.

According to a ninth aspect, an inner diameter of the liquid-side tube is 1 mm to 3.36 mm.

A refrigeration cycle using a flammable refrigerant according to a tenth aspect, a liquid-side tube among the tubes is a capillary tube.

An air conditioner using a flammable refrigerant according to an eleventh aspect, an inner diameter of a liquid-side connecting pipe among the connecting pipes is 1 mm to 3.36 mm.

A refrigeration cycle using a flammable refrigerant according to a twelfth aspect, an inner diameter of a liquid-side tube among the tubes is 1 mm to 3.36 mm.

According to the first to twelfth aspects of the present invention, by reducing a diameter of the tube in which a liquid refrigerant flows in the air conditioner or the refrigeration cycle, it is possible to reduce the amount of refrigerant to be charged without decreasing the capacity and the efficiency.

An air conditioner using a flammable refrigerant according to a thirteenth aspect, a liquid-side connecting pipe is a capillary tube, and the expansion device is an expansion valve having a variable flow rate.

According to this aspect, an opening of the expansion valve can be adjusted by the expansion valve in accordance with a length or diameter of the liquid-side connecting pipe or a state of a refrigeration cycle. Therefore, it is possible to reduce the diameter of the liquid-side connecting pipe, and since the throttle degree can be adjusted by the expansion valve, the diameter can be reduced appropriately, and it is possible to reduce the amount of refrigerant to be charged without decreasing the capacity.

An air conditioner using a flammable refrigerant according to a fourteenth aspect, not only the liquid-side tube of the outdoor unit, but also the liquid-side tube of the indoor unit is provided with an expansion device. Since the liquid-side tube of the indoor unit is also provided with the expansion device in this manner, the refrigerant in the liquid-side connecting pipe can assume a two phase state of gas and liquid during heating operation and therefore, it is possible to reduce the amount of refrigerant to be charged as compared with a liquid refrigerant, and the capacity and the efficiency are not decreased.

A refrigeration cycle using a flammable refrigerant of a fifteenth aspect, an inner diameter of an outlet side tube of the condenser is smaller than an inner diameter of an inlet side tube of the condenser.

According to a sixteenth aspect, the inner diameter of the outlet side tube of the condenser of the fifteenth aspect is less than 42.5% of the inner diameter of the inlet side tube of the condenser.

According to a seventeenth aspect, the inner diameter of the outlet side tube of the condenser of the fifteenth aspect is 1 mm to 3.36 mm.

According to the fifteenth to seventeenth aspects, by reducing a diameter of the tube in which a liquid refrigerant flows in the condenser, it is possible to reduce the amount of refrigerant to be charged without decreasing the capacity and the efficiency.

According to an eighteenth aspect, the number of circuits of the outlet side tubes of the condenser of the fifteenth to seventeenth aspects is greater than that of the inlet side tubes. Although the pressure loss is increased due to a reduction in the diameter, if the tube in which the liquid refrigerant flows is diverged in this manner, the pressure loss can be reduced. Therefore the diameter can be reduced, and the amount of refrigerant can further be reduced.

According to a nineteenth aspect, the inner diameter of the outlet side tube of the condenser of the fifteenth aspect is reduced stepwisely.

According to a twentieth aspect, the inner diameter of the outlet side tube of the condenser of the nineteenth aspect is gradually reduced such that a temperature is changed along a saturated liquid line.

An air conditioner using a flammable refrigerant of a twenty first aspect, the number of circuits of a liquid-side tube of the indoor heat exchanger or the outdoor heat exchanger is greater than that of a gas-side tubes, and when the indoor heat exchanger or the outdoor heat exchanger is functioned as a condenser, the number of circuits of the liquid-side tube is reduced. When indoor heat exchanger or the outdoor heat exchanger is functioned as the condenser in this manner, it is possible to reduce the residence of refrigerant by reducing the number of circuits of the liquid-side tubes. When the outdoor heat exchanger is functioned as an evaporator, the pressure loss around the inlet of the evaporator can be reduced by increasing the number of circuits, and it is possible to efficiently operate the air conditioner.

According to twenty second and twenty third aspects, R290 is used as a main component of the flammable refrigerant mixture in the first, fourth, fifth, eighth, tenth, eleventh, twelfth, thirteenth, fourteenth, fifteenth or twenty first aspect. If R290 refrigerant is compared with R22 refrigerant, since a latent heat of R290 is 1.8 times of that of R22, in order to obtain the same ability, the pressure loss of R290 is 70% of that of R22 if the diameters of the tube are the same. Therefore, the pressure losses of both the refrigerants are equalized, the diameter of tube can be reduced and the amount of refrigerant to be charged can be reduced if R290 refrigerant is used as compared with a case where R22 refrigerant is used.

In the following twenty fourth to thirtieth aspects, the amount of refrigerant to be charged is reduced by reducing a diameter of a tube in which the gas refrigerant flows. At that time, if a diameter of the gas-side tube is reduced, the efficiency is decreased, but comparing with a case in which R22 is used as refrigerant, the efficiency is enhanced if R290 is used as refrigerant. Therefore, paying attention to pressure losses of the R22 and R290 in the present aspect, the diameter of the gas-side tube is reduced such that the pressure losses between R22 and R290 become same.

The inner diameter of the tube when R290 is used such that both the pressure losses becomes equal is 90 to 92% of the inner diameter of the tube when R22 is used. The conventionally used gas-side tube when R22 is used as refrigerant is ⅜ inch tube and ½ inch tube. Therefore, the inner diameter of the gas-side tube corresponding to a case in which R290 is used based on ⅜ inch tube is 7.13 to 7.29 mm, and by setting the inner diameter of the gas-side tube in this range, the same efficiency as a case in which R22 is used as refrigerant can be obtained. Further, since the diameter of the tube can be reduced less than the conventionally used gas-side tube, it is possible to reduce the amount of refrigerant to be charged.

An air conditioner using a flammable refrigerant of the twenty fourth aspect, an inner diameter of a gas-side connecting pipe is 7.13 to 7.29 mm, and an inner diameter of a liquid-side connecting pipe is less than 66.6% of the inner diameter of the gas-side connecting pipe.

According to twenty fifth aspect, the liquid-side connecting pipe of the twenty fourth aspect is a capillary tube.

An air conditioner using a flammable refrigerant according to a twenty sixth aspect, an inner diameter of a gas-side tube of the outdoor unit is 7.13 to 7.29 mm, and an inner diameter of a liquid-side tube is less than 66.6% of the inner diameter of the gas-side tube.

An air conditioner using a flammable refrigerant according to a twenty seventh aspect, an inner diameter of a gas-side tube of the indoor unit is 7.13 to 7.29 mm, and an inner diameter of a liquid-side tube is less than 66.6% of the inner diameter of the gas-side tube of the indoor unit.

According to a twenty eighth aspect, the liquid-side tube of the twenty sixth or twenty seventh aspect is a capillary tube.

A refrigeration cycle using a flammable refrigerant according to a twenty ninth aspect, an inner diameter of a gas-side tube of the tubes is 7.13 to 7.29 mm, and an inner diameter of a liquid-side tube is less than 66.6% of the inner diameter of the gas-side tube.

A refrigeration cycle using a flammable refrigerant according to a thirtieth aspect, an inner diameter of a gas-side tube of the tubes is 7.13 to 7.29 mm, and a liquid-side tube is a capillary tube.

According to the following thirty first to thirty third aspect, a diameter of the connecting pipe is reduced so as to reduce the amount of refrigerant to be charged.

A connecting pipe for an air conditioner of the thirty first aspect, an inner diameter of a liquid-side connecting pipe is less than 42.5% of an inner diameter of a gas-side connecting pipe.

A connecting pipe for an air conditioner of the thirty second aspect, an inner diameter of a liquid-side connecting pipe is 1 mm to 3.36 mm.

A connecting pipe for an air conditioner of the thirty third aspect, an inner diameter of a gas-side connecting pipe is 7.13 mm to 7.29 mm, and an inner diameter of a liquid-side connecting pipe is less than 66.6% of the inner diameter of the gas-side connecting pipe.

BEST MODE FOR CARRYING OUT THE INVENTION

An air conditioner using HC refrigerant of an embodiment of the present invention will be explained based on the drawings below.

Figure 1:
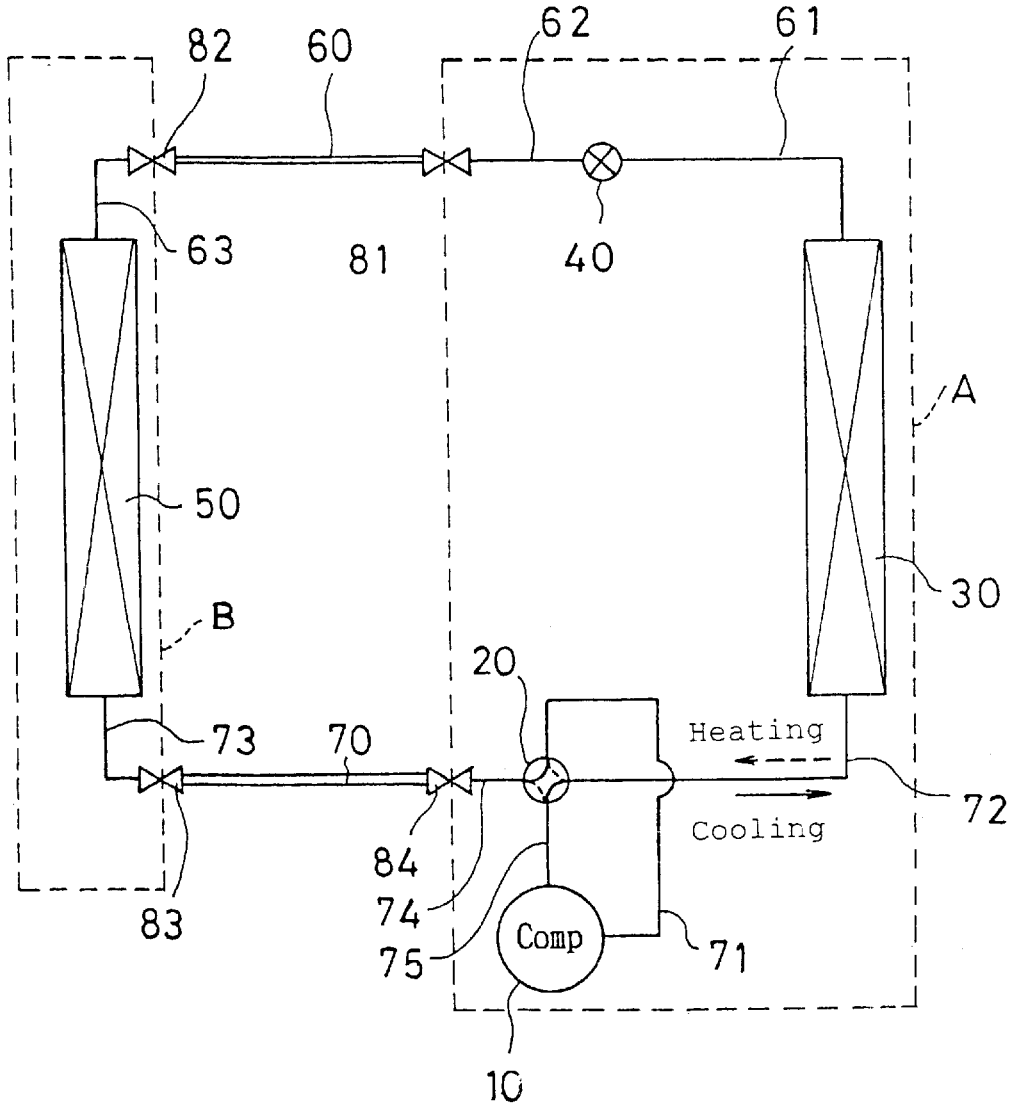
FIG. 1 is a diagram of a refrigeration cycle of an air conditioner for explaining an embodiment of the present invention.

FIG. 1 is a diagram of a refrigeration cycle of the air conditioner for explaining the embodiment.

As shown in FIG. 1, a compressor 10, a four-way valve 20, an outdoor heat exchanger 30, an expansion device 40 and an indoor heat exchanger 50 are connected to one another into an annular shape through tubes to constitute a refrigeration cycle. Here, the compressor 10, the four-way valve 20, the outdoor heat exchanger 30 and the expansion device 40 are provided in an outdoor unit A, and the indoor heat exchanger 50 is provided in an indoor unit B. The outdoor unit A and the indoor unit B are connected to each other through a liquid-side connecting pipe 60 and a gas-side connecting pipe 70. The liquid-side connecting pipe 60 is connected to the expansion device 40 and the indoor heat exchanger 50 through a liquid-side outdoor valve 81 and the liquid-side indoor valve 82, respectively. The gas-side connecting pipe 70 is connected to the indoor heat exchanger 50 and the four-way valve 20 through a gas-side outdoor valve 83 and a gas-side indoor valve 84, respectively.

The tubes constituting the refrigeration cycle comprise a tube 71 connecting the compressor 10 and the four-way valve 20, a tube 72 connecting the four-way valve 20 and the outdoor heat exchanger 30, a tube 61 connecting the outdoor heat exchanger 30 and the expansion device 40, a tube 62 connecting the expansion device 40 and the liquid-side outdoor valve 81, a tube 63 connecting the liquid-side indoor valve 82 and the indoor heat exchanger 50, a tube 73 connecting the indoor heat exchanger 50 and the gas-side indoor valve 84, a tube 74 connecting the gas-side outdoor valve 83 and the four-way valve 20, and a tube 75 connecting the four-way valve 20 and the compressor 10. Here, the tubes 61, 62 and 63 which are occupied by liquid at high rate are called as liquid-side tubes, and the tubes 71, 72, 73, 74 and 75 which are mainly occupied by gas are called as gas-side tubes.

Cooling operation and heating operation are selectively switched by switching the four-way valve 20 to change the flow of the refrigerant. In FIG. 1, the solid line shows a direction of flow of the refrigerant at the time of cooling operation, and the broken line shows a direction of flow of the refrigerant at the time of heating operation.

The tubes used in each of the embodiments of the present invention are shown in Table 1 together with comparative examples. Table 1 shows inner diameter ratios of diameters of the liquid-side tubes to diameters of gas-side tubes of the embodiments of the present invention and the comparative examples when conventionally used ⅜ inch tube and ½ inch tube are used as gas-side tubes.

TABLE 1

| | Ratio of inner diameter of liquid-side tube to inner diameter of gas-side tube | | |
|---|---|---|---|
| | Liquid-side tube | Gas-side tube ⅜ inch tube 7.92 | Gas-side tube ½ inch tube 11.1 |
| Embodiment 1 | 1.000 | 12.6% | 9.0% |
| Embodiment 2 | 1.775 | 22.4% | 16.0% |
| Embodiment 3 | 3.364 | 42.5% | 30.3% |
| Comparative example 1 | 4.750 | 60.0% | 42.8% |

In embodiment 1, those tubes, such as capillary tubes having the average inner diameter of 1 mm are used as each of the liquid-side connecting pipe 60 and the liquid-side tubes 61 to 63. In embodiments 2 and 3, ⅛ inch tubes having the average inner diameter of 1.775 mm, and 3/16 inch tube having the average inner diameter of 3.364 mm are respectively used as each of the liquid-side connecting pipe 60 and the liquid-side tubes 61 to 63. As the gas-side connecting pipe 70 and the gas-side tube 71 to 75, conventionally used ⅜ inch tube having the average inner diameter of 8.13 mm and ½ inch tube having the average inner diameter of 11.3 mm are used respectively.

In the comparative examples 1 and 2, ¼ inch tube having the average inner diameter of 4.95 mm and ⅜ inch tube having the average inner diameter of 8.13 mm, are respectively used as the liquid-side connecting pipe 60 and the liquid-side tubes 61 to 63. Conventionally, if ½ inch tube is used as a gas-side tube, ⅜ inch tube or ¼ inch tube is used as a liquid-side tube, and if ⅜ inch tube is used as the gas-side tube, ¼ inch tube is used as the liquid-tube.

As shown in Table 1, each of the liquid-side tubes (including the liquid-side connecting pipe) of the present embodiment uses a thin tube having an inner diameter smaller than that of the conventionally used liquid-side tube. More specifically, a preferable inner diameter of the liquid-side tube is in a range of 0.84 to 5.11 mm. Referring to the ratio of inner diameter of the liquid-side tube to the inner diameter of the gas-side tube, the liquid-side tube has 42.5% inner diameter of that of the gas-side tube in the case of the conventional comparative example. However, in the present invention, it is preferable to use a thin tube having an inner diameter of less than 42.5% of that of the gas-side tube.

Tables 2 and 3 show refrigerant amount ratio required for obtaining the same capacity for each of the tube diameters shown in Table 1. Table 2 shows the refrigerant amount ratio at the time of cooling operation, and Table 3 shows the refrigerant amount ratio at the time of heating operation. The refrigerant amount ratio shown in each of Tables 2 and 3 is based on a case in which a ⅜ inch tube having an inner diameter of 7.92 mm is used as the gas-side tube, and a ¼ inch tube having an inner diameter of 4.75 mm is used as the liquid-side tube, and the refrigerant amount is considered 100%.

Further, the liquid-side tube had a length of 8 m including the connecting pipe. On the other hand, as to the gas-side tube including the connecting pipe, a portion of the gas-side tube whose pressure is higher at the time of cooling operation has 1 m length, a portion of the gas-side tube whose pressure is lower at the time of cooling operation has 8 m length, a portion of the gas-side tube whose pressure is higher at the time of heating operation has 8 m length, and a portion of the gas-side tube whose pressure is reduced at the time of heating operation has 1 m length. As to a ratio of refrigerant amount, a refrigerant amount of the comparative example 1 is 385 g, and this is used as a reference value.

In the comparative example 1, ⅜ inch tube was used as the gas-side tube, and ¼ inch tube was used as the liquid-side tube. The liquid density of the refrigerant was 472 kg/m$^3$, the high pressure gas density is 34.1 kg/m$^3$ and the low pressure gas density was 12.5 kg/m$^3$. R290 was used as the refrigerant in each of the embodiments and comparative examples.

TABLE 2

| Refrigerant amount ratio required for obtaining the same capacity (cooling operation) | | | |
|---|---|---|---|
| Liquid-side tube | | Gas-side tube ⅜ inch tube 7.92 | Gas-side tube ½ inch tube 11.1 |
| Embodiment 1 | 1.000 | 96.0% | 97.0% |
| Embodiment 2 | 1.775 | 96.4% | 97.3% |
| Embodiment 3 | 3.364 | 97.9% | 98.4% |
| Comparative example 1 | 4.750 | 100.0% | 100.0% |

TABLE 3

| Refrigerant amount ratio required for obtaining the same capacity (heating operation) | | | |
|---|---|---|---|
| Liquid-side tube | | Gas-side tube ⅜ inch tube 7.92 | Gas-side tube ½ inch tube 11.1 |
| Embodiment 1 | 1.000 | 85.3% | 88.9% |
| Embodiment 2 | 1.775 | 86.8% | 90.0% |
| Embodiment 3 | 3.364 | 92.3% | 94.2% |
| Comparative example 1 | 4.750 | 100.0% | 100.0% |

As shown in Tables 2 and 3, in the examples 1 to 3, the same capacity can be obtained with maximum 85% refrigerant amount. In this way, the refrigerant amount can be reduced by reducing the diameter of the liquid-side connecting pipe.

If a capillary tube is used as the liquid-side connecting pipe 60 as another embodiment, it is preferable that the expansion device 40 is a controllable expansion valve, and compressor intake super heat is adjusted by this expansion valve such that the refrigeration cycle temperature becomes equal to a predetermined discharge temperature in accordance with a length or a diameter of the liquid-side connecting pipe 60.

In another embodiment of the present invention, an expansion device is newly added to the liquid-side tube 63. By adding the expansion device to the liquid-side tube 63 in this manner, the refrigerant flowing through the liquid-side connecting pipe 60 and the liquid-side tube 62 can be brought into a gas-liquid two phase state. Therefore, it is possible to reduce the liquid refrigerant in an amount corresponding to an amount of gas occupying in the tube and thus, the amount of refrigerant can be reduced.

Another embodiment of the heat exchanger will be explained below.

Figure 2:
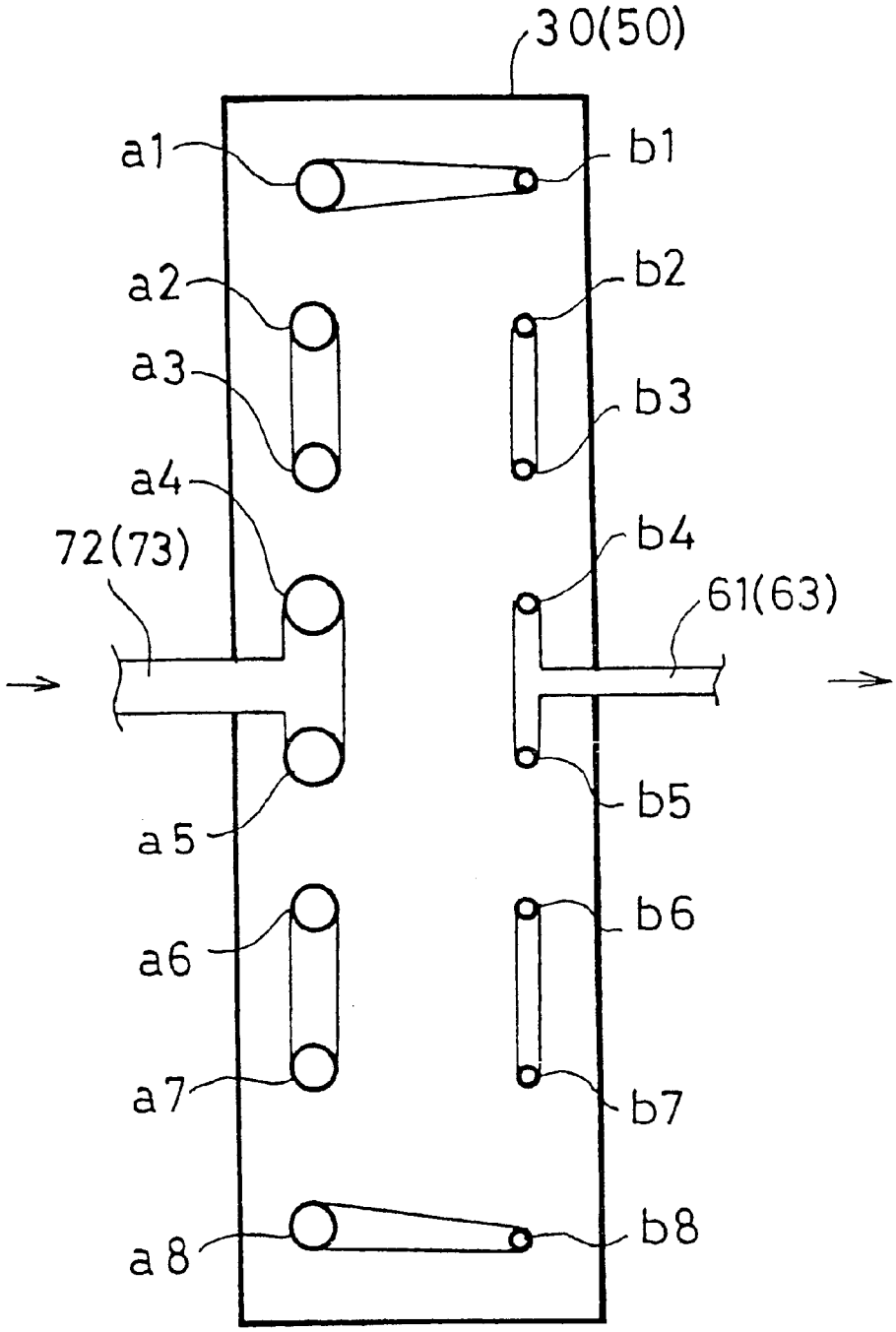
FIG. 2 is a diagram of a side structure of a heat exchanger of the embodiment of the invention.

In one embodiment of the heat exchanger of the present invention, the inner diameter of the outlet side tube of the condenser is made smaller than that of the inlet side tube. This embodiment is shown in FIG. 2. FIG. 2 is a schematic view of structure of the outdoor heat exchanger 30 or the indoor heat exchanger 50 as viewed from side. For simplifying the explanation, it will be made for the outdoor heat exchanger 30 only, and only the corresponding the reference numbers are shown for the indoor heat exchanger 50.

As shown in FIG. 2, the outdoor heat exchanger 30 (50) comprises two rows and 8 stages of tubes a1 to a8 and b1 to b8 vertically inserted through plate fins. The outdoor heat exchanger 30 (50) divided into two paths, i.e., the gas-side tube 72 (73) is connected to the tubes a4 and a5 of the first row, and the liquid-side tube 61 (63) is connected to the tubes b4 and b5 of the second row.

Diameters of the tubes b1 to b8 are smaller than those of the tube a1 to a8. One end of the tube a4 which is opposite from the outdoor heat exchanger 30 (50) is connected to the tube a3, and the tube a3 is connected to the tube a2 as shown in FIG. 2. One end of the tube a2 which is opposite from the outdoor heat exchanger 30 (50) is connected to the tube a1. On the other hand, one end of the tube b4 which is opposite from the outdoor heat exchanger 30 (50) is connected to the tube b3, and the tube b3 is connected to the tube b2 as shown in FIG. 2. One end of the tube b2 which is opposite from the outdoor heat exchanger 30 (50) is connected to the tube b1. The tubes a5 to a8 as well as the tubes b5 to b8 are also connected in the same manner as the tubes a4 to al and the tubes b4 to b1. The tubes a1 and b1 are connected to each other, and the tubes a8 and b8 are connected to each other. Here, the tubes a1 and b1 having different diameters are connected, and the tubes a8 and b8 having different diameters are connected.

By reducing the diameter of the liquid-side tube as in the present embodiment, the amount of the refrigerant can further be reduced. In the present embodiment, the diameters of the tubes of the first row and the diameters of the tubes of the second row are different, but the diameters of the tubes of the same row may be different. Further, the outer heat exchanger 30 (50) comprises more than thee row of tubes, each row of tubes may have different diameters, or the second and third row of tubes have the same diameter, and the first row of tube may have diameter smaller than those of the second and third row of tubes.

Figure 3:
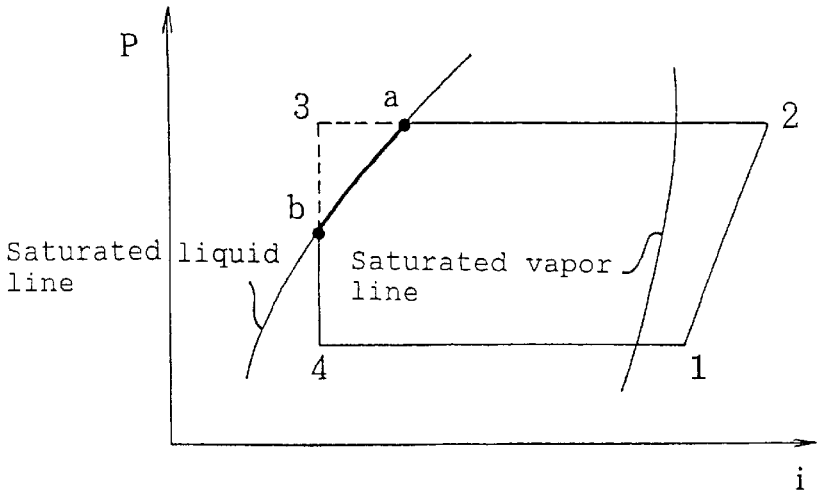
FIG. 3 is a Mollier diagram showing a state of the embodiment of the invention.

As another embodiment of the heat exchanger, the diameter of the liquid-side tube may be gradually throttled or reduced. In this case, it is preferable to gradually reduce the diameter along the saturated liquid line. Such a throttled state will be explained based on Mollier diagram in FIG. 3. In FIG. 3, 1→2 shows compression process, 2→3 shows condensation process, 3→4 shows expansion process, and 4→1 shows vaporization process. By gradually throttling the diameter of the liquid-side tube of the outer heat exchanger 30 (50) such that the temperature is changed along the saturated liquid line, it is possible to bring the state from the condensation process to throttle process into 2→a→b→4. By gradually throttling the diameter of the liquid-side tube such that the temperature is changed along the saturated liquid line, it is possible to reduce the amount of refrigerant without deteriorating the heat exchanging capacity.

In the present embodiment, it is possible to further throttle the inner diameter of the outlet-side tube by increasing the number of paths of the outlet-side of the condenser greater than that of the inlet-side.

Further, ratio of inner diameter of liquid-side tube to inner diameter of gas-side tube can also be applied to the diameters of the outlet-side tube and the inlet-side tube of the condenser.

Figure 4:
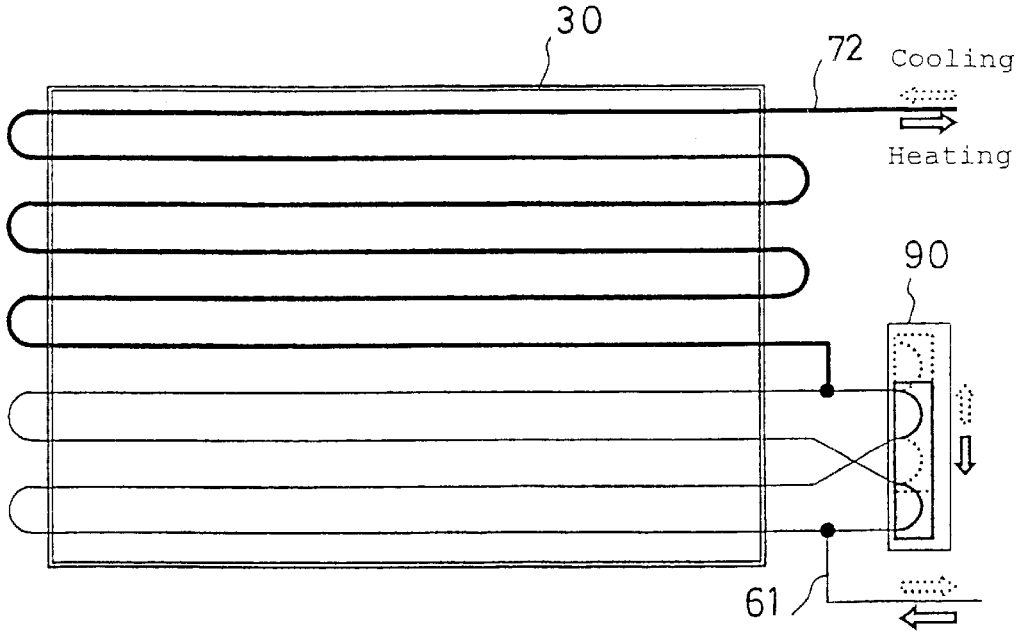
FIG. 4 is a diagram showing a structure of an outdoor heat exchanger of the embodiment of the invention.

Another embodiment of the heat exchanger is shown in FIG. 4. FIG. 4 is a schematic diagram showing a structure of an outdoor heat exchanger. In FIG. 4, a tube shown with a thick line has a greater diameter than a tube shown with a thin line. Elements similar to those shown in FIG. 1 are designated by the same reference number, and its explanation is omitted.

In the present embodiment, the number of circuits of the liquid-side tubes is increased as compared with the gas-side tubes when the outdoor heat exchanger 30 is used as an evaporator, and the number of circuits of the liquid-side tubes is decreased when the outdoor heat exchanger 30 is used as a condenser. In the present embodiment, the inner diameter of the liquid-side tube is smaller than that of the gas-side tube. In FIG. 4, 90 represents tube connection switching means for changing the number of circuits.

Figure 5:
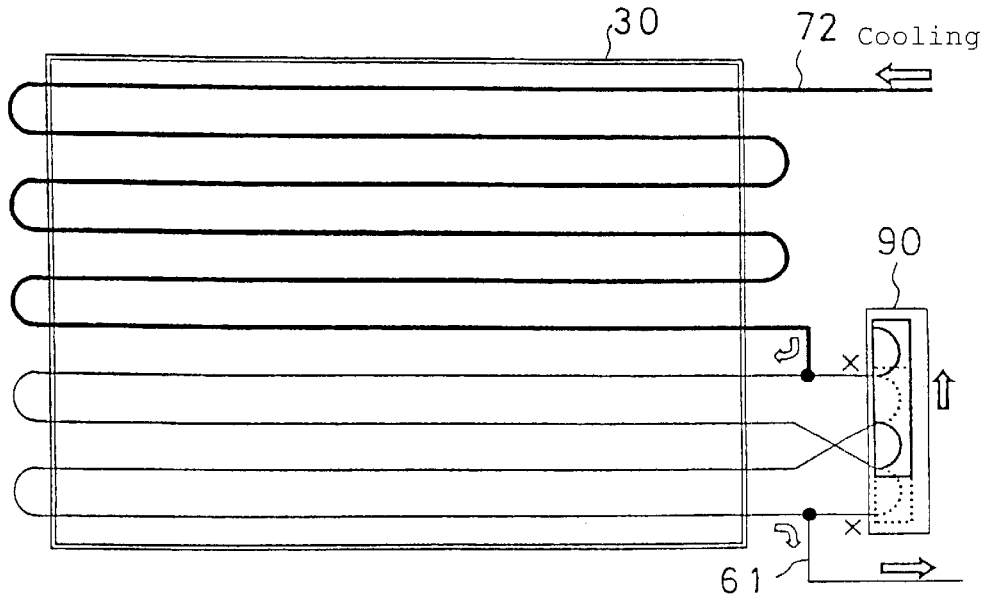
FIG. 5 is a diagram showing a flow of refrigerant when the outdoor heat exchanger shown in FIG. 4 is functioned as a condenser.

A flow of the refrigerant of the present embodiment will be explained with reference to FIGS. 5 and 6. FIG. 5 is a diagram showing a structure of tubes when the outdoor heat exchanger is functioned as a condenser; and FIG. 6 is a diagram showing structure of tubes when the outdoor heat exchanger is functioned as an evaporator.

When the outdoor heat exchanger is functioned as the condenser as shown in FIG. 5, all of the tubes in the outdoor heat exchanger 30 are arranged in series through the tube connection switching means 90 to form one circuit. Therefore, the refrigerant coming from the gas-side tube 72 flows out from the liquid-side tube 62 without being diverged in the outdoor heat exchanger 30.

Figure 6:
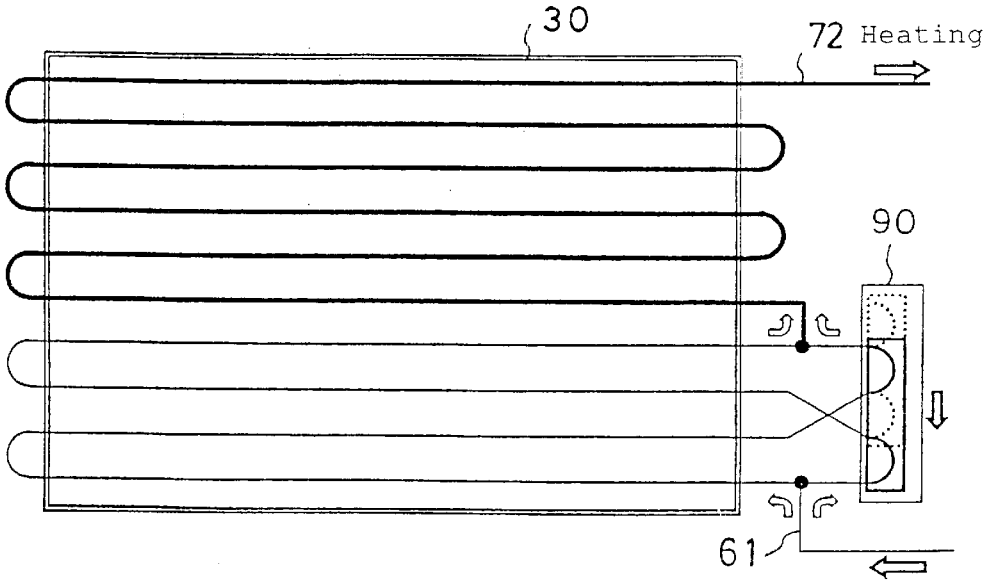
FIG. 6 is a diagram showing a flow of refrigerant when the outdoor heat exchanger shown in FIG. 4 is functioned as an evaporator.

On the other hand, when the outdoor heat exchanger is functioned as the evaporator as shown in FIG. 6, the tubes in the outdoor heat exchanger 30 are connected to form two circuits by the tube connection switching means 90. Therefore, the refrigerant coming from the gas-side tube 72 is diverged into two circuits and again join halfway into one path and flows out from the gas-side tube 72.

According to the present embodiment, when the outdoor heat exchanger 30 is used as a condenser, it is possible to reduce the residence of refrigerant by reducing the number of circuits of the liquid-side tubes. And it also enables that exchangers to work effectively, because root transfer of liquid is correspondingly lower than that of 2-phase flow.

Next, an embodiment for reducing an amount of refrigerant to be charged by throttling a diameter of a tube in which gas refrigerant flows will be explained.

If the gas-side tube is throttled, the efficiency is of the system generally lowered, but comparing with a case in which R22 is used as refrigerant, the efficiency is enhanced if R290 is used as refrigerant. Therefore, paying attention to pressure drop of the R22 and R290 in the present embodiment, the diameter of the gas-side tube is throttled such that the pressure drop in a tube between R22 and R290 become same.

Table 4 shows a ratio of pressure drop of R290 to that of R22 when the inner diameter of the tube is reduced. The tube diameter ratio of 100% shows a pressure drop of R290 with respect to R22 with the same tube diameter. In the experiment, a tube having an inner diameter of 0.671 mm is used as a reference tube, and a tube having a diameter of 0.6173 mm and a tube having a diameter of 0.6039 mm are used.

TABLE 4

Ratio of pressure drop when diameter of tube is reduced

| | | Ratio of tube diameter | | |
|---|---|---|---|---|
| | | 100% | 92% | 90% |
| Ratio of pressure drop (R290/R22) | High pressure Gas tube | 0.655 | 0.974 | 1.081 |
| | Low pressure Gas tube | 0.631 | 0.938 | 1.042 |

As is shown in Table 4, if the tubes having the same inner diameters are used, it can be found that the ratio of pressure drop of refrigerant of R290 to refrigerant of R22 is 0.655 in a high pressure gas region at the cycle for obtaining the same capacity, and the ratio of pressure drop is 0.631 in a low pressure gas region.

As can be found from Table 4, the inner diameter of the tube when R290 is used such that both the pressure drops become equal is approximately from 90 to 92% of the inner diameter of the tube when R22 is used.

The conventionally used gas-side tube when R22 is used as refrigerant is ⅜ inch tube and ½ inch tube. Therefore, the inner diameter of the gas-side tube corresponding to a case in which R290 is used based on ⅜ inch tube is 7.13 to 7.29 mm, and by setting the inner diameter of the gas-side tube in this range, the same efficiency as a case in which R22 is used as refrigerant can be obtained. Further, since the diameter of the tube can be reduced less than the conventionally used gas-side tube, it is possible to reduce the amount of refrigerant to be charged.

If the inner diameter of the gas-side tube is set in the range of 7.13 to 7.29 mm, the diameter of the liquid-side tube can be reduced. Table 5 shows a ratio of inner diameter of the liquid-side tube to the inner diameter of the gas-side tube wherein embodiment 4 uses capillary tube as liquid-side tube, embodiment 5 uses ⅛ inch tube, embodiment 6 uses 3/16 inch tube and embodiment 7 uses ¼ inch tube.

TABLE 5

| Ratio of inner diameter of the liquid-side tube to the inner diameter of the gas-side tube | | |
|---|---|---|
| Liquid-side tube | | Gas-side tube 7.13–7.29 |
| Embodiment 4 | 1.000 | 14.0%–13.7% |
| Embodiment 5 | 1.775 | 24.9%–24.3% |
| Embodiment 6 | 3.364 | 47.2%–46.1% |
| Embodiment 7 | 4.750 | 66.6%–65.2% |

As shown in Table 5, when the conventional tube is effectively utilized, a tube having inner diameter less than ¼ inch tube can be utilized as a liquid-side tube and in this case, a ratio of inner diameter of the liquid-side tube to that of the gas-side tube is 66.6% or less.

Tables 6 and 7 show refrigerant amount ratio required for obtaining the same capacity wherein the tubes of the embodiments 4 to 7 are used, the comparative example uses R22 as refrigerant, ⅜ inch tube (8.13 mm) as the gas-side tube, ¼ inch tube (4.95 mm) as the liquid-side tube, and the amount of refrigerant of this component is 100%. Each of the embodiments 4 to 7 shown in Tables 6 and 7 uses R290 as refrigerant, and Table 6 shows the refrigerant amount at the time of cooling operation, and Table 7 shows the refrigerant amount at the time of heating operation.

Further, the liquid-side tube had a length of 8 m including the connecting pipe, the gas-side tube including the connecting pipe had a high pressure side of 1 m length and a low pressure side of 8 m length both at the time of cooling operation, and had a high pressure side of 8 m length and a lower pressure side of 1 m length both at the time of heating operation. The reference refrigerant amount was 385 g using ⅜ inch tube as the gas-side tube and ¼ inch tube as the liquid-side tube. The liquid density of the refrigerant was 819 kg/m$^3$, the high pressure gas density of R290 is 34.1 kg/m$^3$ and the low pressure gas density was 12.5 kg/m$^3$.

TABLE 6

| Refrigerant amount ratio required for obtaining the same capacity (cooling operation) | | |
|---|---|---|
| Liquid-side tube | | Gas-side tube 7.13–7.29 |
| Embodiment 4 | 1.000 | 45.0% |
| Embodiment 5 | 1.775 | 45.0% |
| Embodiment 6 | 3.364 | 46.0% |
| Embodiment 7 | 4.750 | 47.0% |

TABLE 7

| Refrigerant amount ratio required for obtaining the same capacity (heating operation) | | |
|---|---|---|
| Liquid-side tube | | Gas-side tube 7.13–7.29 |
| Embodiment 4 | 1.000 | 40.0% |
| Embodiment 5 | 1.775 | 40.0% |
| Embodiment 6 | 3.364 | 43.0% |
| Embodiment 7 | 4.750 | 47.0% |

As can be seen in Tables 6 and 7, as compared with a case in which ⅜ inch tube is used as the gas-side tube, ¼ inch tube is used as the liquid-side tube and R22 is used as refrigerant, the embodiments 4 to 7 can obtain the same capacity with 40 to 49% of the amount of refrigerant. By using R290 as refrigerant in this manner, the diameter of the gas-side tube can be reduced, and if the diameter of the liquid-side tube is reduced in correspondence with the gas-side tube, the amount of refrigerant can further be reduced.

If a groove tube is used as refrigerant tube, the inner diameter should be the average inner diameter.

POSSIBILITY OF INDUSTRIAL UTILIZATION

As described above, according to the present invention,

Thereupon, the amount of refrigerant to be charged in the refrigeration cycle can be reduced without decreasing the capacity and efficiency.

Further, the amount of refrigerant to be charged in the refrigeration cycle can be reduced without decreasing the capacity if R290 is used or mainly used as the refrigerant, while obtaining substantially the same efficiency as the case in which R22 is used as refrigerant.

According to the present invention, it is possible to decrease possibility of explosion or ignition and to increase the safety by reducing the amount of refrigerant to be charged in the refrigeration cycle.

What is claimed is:

1. A refrigeration cycle using a flammable refrigerant, comprising: a condenser, an evaporator, a compressor and an expansion device; all connected to one another through tubes to constitute a refrigeration cycle, wherein an inner diameter of an outlet side tube of said condenser is throttled smaller than an inner diameter of an inlet side tube of said condenser, wherein the inner diameter of said outlet side tube of said condenser is less than 42.5% of the inner diameter of said inlet side tube of said condenser.

2. A refrigeration cycle using a flammable refrigerant according to claim 1, wherein the number of paths of the outlet side tubes of said condenser is greater than that of the inlet side tubes.

3. A refrigeration cycle using a flammable refrigerant, comprising: a condenser, an evaporator, a compressor and an expansion device; all connected to one another through tubes to constitute a refrigeration cycle, wherein an inner diameter of an outlet side tube of said condenser is throttled smaller than an inner diameter of an inlet side tube of said condenser, wherein the inner diameter of said outlet side tube of said condenser is reduced stepwisely.

4. A refrigeration cycle using a flammable refrigerant according to claim 3, wherein the inner diameter of said outlet side tube of said condenser is gradually reduced.

5. An air conditioner using a flammable refrigerant, comprising: an indoor heat exchanger provided in an indoor unit, an outdoor heat exchanger provided in an outdoor unit, a compressor, and an expansion device, all connected to one another through tubes to constitute a refrigeration cycle, R290 being used as a main component of said refrigerant, and said indoor unit and said outdoor unit being connected to each other using connecting pipes, wherein an inner diameter of a gas-side connecting pipe of said connecting pipes is 7.13 to 7.29 mm, and an inner diameter of a liquid-side connecting pipe is less than 66.6% of the inner diameter of said gas-side connecting pipe.

6. An air conditioner using a flammable refrigerant according to claim 5, where said liquid-side connecting pipe is a capillary tube.

7. An air conditioner using a flammable refrigerant, comprising: an indoor heat exchanger provided in an indoor unit, an outdoor heat exchanger provided in an outdoor unit, a compressor, and an expansion device, all connected to one another through tubes to constitute a refrigeration cycle, R290 being used as a main component of said refrigerant, and said indoor unit and said outdoor unit being connected to each other using connecting pipes, wherein an inner diameter of a gas-side tube of said outdoor unit is 7.13 to 7.29 mm, and an inner diameter of a liquid-side tube is less than 66.6% of the inner diameter of said gas-side tube.

8. An air conditioner using a flammable refrigerant, comprising: an indoor heat exchanger provided in an indoor unit, an outdoor heat exchanger provided in an outdoor unit, a compressor, and an expansion device, all connected to one another through tubes to constitute a refrigeration cycle, R290 being used as a main component of said refrigerant, and said indoor unit and said outdoor unit being connected to each other using connecting pipes, wherein an inner diameter of a gas-side tube of said indoor unit is 7.13 to 7.29 mm, and an inner diameter of liquid-side tube of said indoor unit is less than 66.6% of the inner diameter of said gas-side tube of said indoor unit.

9. An air conditioner using a flammable refrigerant according to claim 7 or 8, wherein said liquid-side tube is a capillary tube.

10. A refrigeration cycle using a flammable refrigerant, comprising: a condenser, an evaporator, a compressor and an expansion device; all connected to one another through tubes to constitute a refrigeration cycle, and R290 is used as a main component of said refrigerant, wherein an inner diameter of a gas-side tube of said tubes is 7.13 to 7.29 mm, and an inner diameter of a liquid-side tube is less than 66.6% of the inner diameter of said gas-side tube.

11. A refrigeration cycle using a flammable refrigerant, comprising: a condenser, an evaporator and a compressor; all connected to one another through tubes to constitute a refrigeration cycle, and R290 being used as a main component of said refrigerant, wherein an inner diameter of a gas-side tube of said tubes is 7.13 to 7.29 mm, and a liquid-side tube is a capillary tube.

12. A connecting pipe for an air conditioner which connects an indoor unit and an outdoor unit with each other, wherein an inner diameter of a liquid-side connecting pipe is less than 42.5% of an inner diameter of a gas-side connecting pipe.

13. A connecting pipe for an air conditioner which connects an indoor unit and an outdoor unit with each other, wherein an inner diameter of a gas-side connecting pipe is 7.13 mm to 7.29 mm, and an inner diameter of a liquid-side connecting pipe is less than 66.6% of the inner diameter of said gas-side connecting pipe.

14. A refrigeration cycle using a flammable refrigerant, comprising: a condenser, an evaporator, a compressor and an expansion device; all connected to one another through tubes to constitute a refrigeration cycle, wherein an inner diameter of an outlet side tube of said condenser is throttled smaller than an inner diameter of an inlet side tube of said condenser, wherein the number of paths of the outlet side tubes of said condenser is greater than that of the inlet side tubes.

* * * * *